US005307030A

United States Patent [19]

King et al.

[11] Patent Number: 5,307,030

[45] Date of Patent: Apr. 26, 1994

[54] COUPLING ADJUSTMENT OF MICROWAVE SLOTS

[75] Inventors: Ray J. King, Pleasanton; Michael J. Werner, Livermore, both of Calif.

[73] Assignee: KDC Technology Corp., Livermore, Calif.

[21] Appl. No.: 944,523

[22] Filed: Sep. 14, 1992

[51] Int. Cl.[5] ..... H01P 5/04

[52] U.S. Cl. ..... 333/24 R; 333/111; 333/246

[58] Field of Search ..... 333/111, 246, 260, 24 R

[56] References Cited

U.S. PATENT DOCUMENTS 2,735,069 2/1956 Riblet ..... 333/111 X
3,094,677 6/1963 Theriot ..... 333/111
3,760,304 9/1973 Cohn .

*Primary Examiner*—Paul Gensler
*Attorney, Agent, or Firm*—Henry P. Sartorio

[57] ABSTRACT

The invention is method and apparatus for in situ mechanical adjustment of electromagnetic power coupled through an aperture or slot. In its preferred form this adjustment of coupling is achieved by electrically connecting two thin, curved conductive leaf springs (20) to ground plane (14) at the ends of the coupling aperture or slot (12). The springs (20) are curved so as to bend away from the center of the aperture or slot opening (12). The aperture or slot is usually enclosed by a metal backing cavity (22) to prevent radiation from the rear of the aperture or slot and to provide a method for mechanically adjusting the position of springs (20) over the aperture or slot (12), e.g., by adjustment of screws (24). By advancing or retracting screws (24), leaf springs (20) are caused to progressively cover or uncover aperture or slot (12), thereby adjusting the electric field across the aperture or slot (12) and the coupled electromagnetic power through the aperture or slot (12). With this method and apparatus, a wide range of impedance matching to the slot feed line (15) can be adjusted as desired.

17 Claims, 3 Drawing Sheets

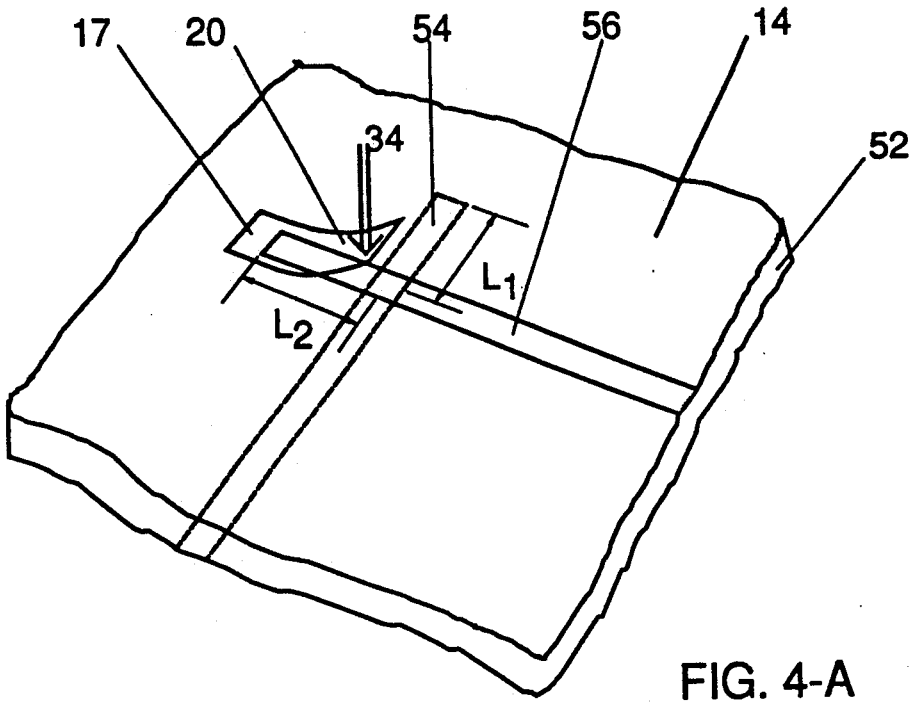
FIG. 4-A
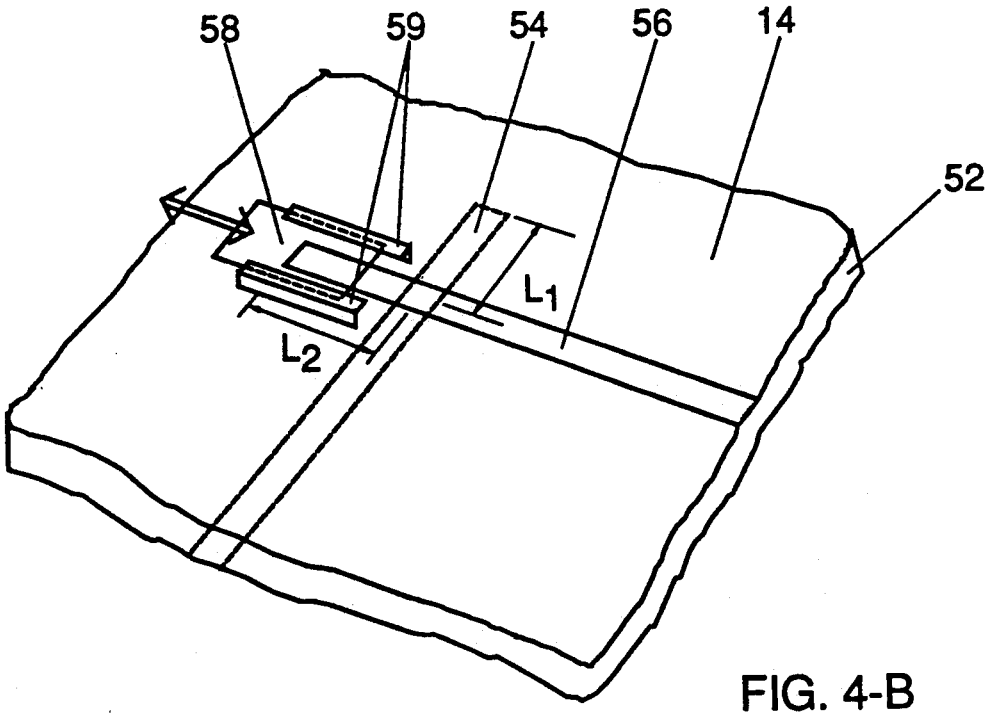
FIG. 4-B

COUPLING ADJUSTMENT OF MICROWAVE SLOTS

GOVERNMENT RIGHTS

This invention was made with Government support under Contract 50-DKNA-8-00168 awarded by the U.S. Department of Commerce/NOAA, and Contract N68335-89-C-0455, awarded by the Naval Air Engineering Center. The Government has certain rights in the invention.

BACKGROUND—FIELD OF INVENTION

This invention relates to the use of mechanical methods and means for adjustment of electromagnetic coupling via microwave apertures or slots.

BACKGROUND—DISCUSSION OF PRIOR ART

A narrow aperture or slot in a thin conducting ground plane is an effective and widely used path for coupling microwave or millimeter wave power from one region to another. Applications include inductive coupling of a semi-rigid coaxial or planar transmission line on one side of the ground plane to another transmission line, a resonator, a waveguide, or a radiating device on the other side. The transmission lines, resonators, antennas, etc. are often of the microstrip line, strip line or slot line varieties. A design problem invariably encountered is the control or adjustment of the amount or degree of electromagnetic coupling through the aperture or slot so as to achieve a desired impedance match over prescribed frequency ranges. Designers usually have the option of varying several parameters such as the slot length and width, the proximity of the transmission line to the slot on one side and/or the proximity of the coupled device on the other side, or by positioning the slot at optimum locations in the standing wave fields of the transmission line and/or the coupled device. Cohn U.S. Pat. No. 3,760,304) discloses novel ways of feeding apertures, slots and slot lines, and many applications of slot coupling. Of these, the slot length is the most effective single common independent parameter for most configurations and applications of coupling slots. While the slot length can be calculated, taking into account the many other parameters that contribute to the coupling, some adjustment in slot length is usually required in the physical realization. Moreover, if some of these parameters change in the course of construction or use of the manufactured product, some readjustment of the slot length may be required to maintain the desired coupling and product performance. Once the microwave device is built, it is usually difficult to adjust the slot length either in the manufacturing plant or in the field. Adjustments are usually done on a cut-and-try basis by disassembling the product, positioning the slot in a milling machine, increasing the slot length by small increments at both ends, and then reassembling and testing the product. Repeating this process may be required to converge on the desired performance of the coupling slot. Obviously, this is a very costly and time-consuming process. Further, the slot length can only be increased by this method. If the optimum length is exceeded, the part must be scrapped.

In some applications, loading of the coupled transmission line or coupled device may change. This happens, for example, when the standing wave on the coupled line changes due to reflections elsewhere on the line, or when the environment of resonant coupled devices such as antennas and cavities changes. Such events may be unintentional, (e.g., ice loading on an antenna) or intentional (e.g., when a dielectric material being measured in a cavity is altered), and they can cause gross mismatches in the slot coupling. In these cases, some method for mechanical adjustment of the aperture or slot coupling is highly desirable.

Prior art shows no simple in situ method for mechanically increasing or decreasing slot coupling at microwave or millimeter wave frequencies. SUMMARY OF THE INVENTION The invention is method and apparatus for mechanically adjusting the coupling factor of an electromagnetic coupling aperture or slot in situ. Mechanical coupling adjustment means are operatively connected to the aperture or slot to selectively change its effective length. This is achieved in a preferred embodiment by fixedly attaching, e.g., by welding or soldering, two narrow, thin and conducting leaf springs to the ground plane at the two ends of the aperture or slot. Each of these curved springs has a width somewhat greater than the slot width and a length somewhat smaller than half the slot length. The two springs are positioned over and parallel to the two halves of the slot with the curved portion progressively bending away from the ground plane as the center of the slot length is approached. By applying mechanical force against the two unattached spring ends simultaneously, the springs are symmetrically compressed or released so as to progressively cover or uncover the slot opening along the slot length. In this manner, the effective length of the slot can be altered, thereby adjusting the electromagnetic power coupled through the slot. Equivalently, the impedance match (or coupling factor) between the slot feed line and the inductively coupled line or device can be adjusted to achieve undercoupling, critical coupling or overcoupling as desired.

A further advantage of this invention is its small size. Typically, the slot length is somewhat shorter than one half the wavelength which corresponds to the first resonant frequency of the slot.

In alternate embodiments other coupling adjustment means, e.g., a sliding metal strip, can be used instead of the leaf spring. Also a single coupling adjustment means at one end of the slot or aperture can be used instead of a pair at the two ends.

The invention permits adjustment of the slot coupling to achieve desired properties as related to the standing wave ratio of the feed line, and the bandwidth or the efficiency. Wide ranges of the coupling factor can be achieved, typically ranging from greatly undercoupled to greatly overcoupled.

OBJECTS AND ADVANTAGES

Accordingly, the following objects and advantages of the invention are claimed:

To provide a method and apparatus for mechanically adjusting the electromagnetic coupling through an aperture or a slot in a ground plane so as to achieve desired coupling over a prescribed frequency range. The invention provides a method and apparatus for adjusting the power flow from a microwave feed network on one side of the ground plane to another microwave network or device on the other side of the ground plane. With this method and apparatus, desired input impedance matching can easily be achieved. Equivalently, the coupling factor can be adjusted.

Aperture or slot coupling is a widely used method for inductively transferring microwave power through a conducting ground plane without requiring feed-through conductors or other direct conductive contact between the feed network and the coupled network. Consequently, the coupled network is driven in a perfectly balanced manner, without need for a feed balun. The ground plane provides the advantage of completely isolating the two regions on either side; that is, the feed and coupled networks are completely shielded from each other except for the aperture or slot coupling. Thus, aperture or slot coupling completely isolates low frequency and direct currents (dc) and voltages.

Another advantage of being able to adjust the coupling by the invention lies in the reduced dependence on other design parameters commonly used to achieve desired coupling. For example, a commonly used method for feeding a slot or slot line is to pass an open or short circuited microstrip line near the slot at right angles. By proper choice of the length of the open or short circuited stub extending beyond the slot, the coupling through the slot is determined. With the present method, the stub is eliminated and the ungrounded conductor of the line can be directly connected across the slot.

Still another advantage of this invention is that both coaxial and planar transmission lines can be used to feed the aperture or slot equally well.

DESCRIPTION OF DRAWINGS

The characteristics and advantages of the invention will appear from the following description illustrated by the figures which show:

FIGS. 4A,B: A perspective view in accordance with the invention depicting its use to adjust the coupling between a microstrip line and a slot line.

LIST OF REFERENCE NUMERALS

Figure 1:
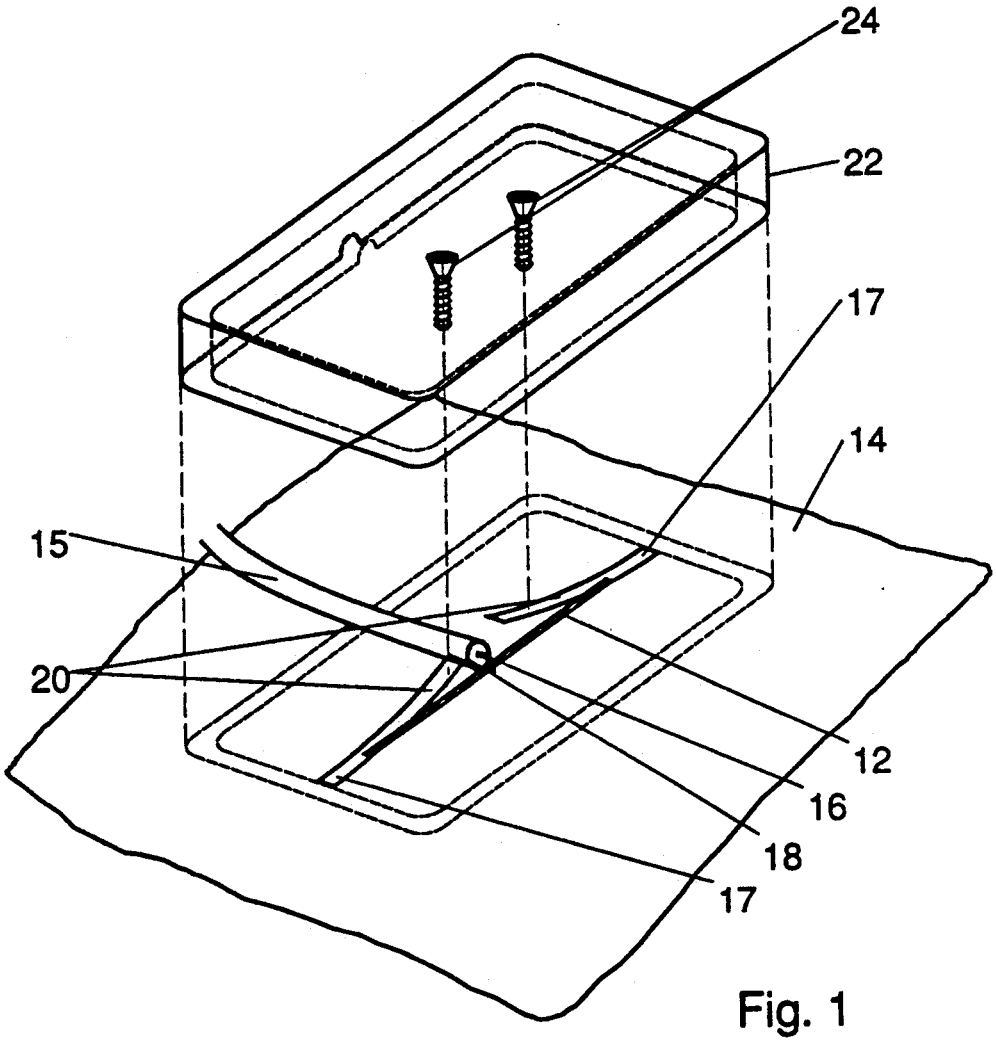
FIG. 1: A perspective view in accordance with the invention depicting its use to adjust the aperture or slot coupling, as directly fed by a coaxial line.

12—slot in ground plane 14
14—ground plane
15—coaxial feed cable
16—center conductor of coaxial feed cable 15
17—end of leaf spring 20 with solder or weld connection to ground plane 14
18—solder or weld connection of the coaxial cable 15 shield to ground plane 14
20—conducting leaf spring
22—metal shielding enclosure
23—solder or weld connection of microstrip line 30 to ground plane 14
24—screws for adjusting the position of leaf springs 20
30—microstrip feed line
32—dielectric substrate of microstrip line 30
34—mechanical force for adjusting the position of leaf springs 20
40—curved edge of plunger 42
42—plunger for mechanically adjusting the position of leaf springs 20 over slot 12
44—guide for plunger 42
46—screw for adjusting the position of plunger 42
48—circular recess in plunger 42, which conforms to the circular cross section of coaxial cable 15
52—substrate on opposed surface of ground plane 14
54—open-circuited microstrip line etched on substrate 52
56—slot line in ground plane 14
58—sliding conductor for shorting the electric field at the end of slot line 56
59—guides for sliding conductor 58

OPERATION OF THE INVENTION

Referring now to the drawings, FIG. 1 shows an aperture or slot 12 which has been machined or etched in an electrically thin conducting ground plane 14. In this example, a coaxial cable 15 serves as a feed line to the slot 12 by connecting the cable center conductor 16 across the slot 12. The sheath of cable 15 is electrically connected at connection 18 (e.g., by soldering or welding) to the back side (top) of ground plane 14. Here, the invention is comprised of two metal leaf springs 20 that are electrically connected to the back side (top) of ground plane 14, e.g., by soldering or welding at spring ends 17 near the two ends of the slot 12. The springs 20 are curved so that the unattached ends bend away from the slot opening along the slot length toward the slot center. The slot 12 and leaf spring arrangement 20 are usually enclosed by a metal backing cavity 22 which is electrically connected to ground plane 14 around the cavity perimeter, shown here in exploded perspective. The cavity 22 serves as a shield to prevent radiation from the rear (or top) of the aperture or slot, and also as a support means for mechanically adjusting the position of leaf springs 20 over slot 12. Here, this adjustment is accomplished using two symmetrically positioned screws 24 mounted in the backing cavity 22. By advancing or retracting screws 24, the leaf springs 20 are caused to progressively cover or uncover slot 12 from both ends, thereby adjusting the distribution of the electric field across the slot or aperture 12 according to the varying distance between the slot 12 and the springs 20. The screws 24 can be either a conductor (e.g., metal) or a dielectric (e.g., Nylon ® or Teflon ®).

Note that conductive contact between the edges of springs 20 and slot 12 is not required but can occur. The physical proximity of the metal springs 20 over the rear of slot 12 is sufficient to adjust the electric field across the slot 12, thereby adjusting the inductive coupling through the slot to the material (e.g., air, lines or other coupled devices) in proximity to the slot front (below the ground plane 14).

The length of slot 12 is typically one half wavelength at the highest frequency of intended use. Then, with the springs attached and fully relaxed away from slot 12, the first resonant frequency of the slot will be somewhat higher than the highest frequency of intended use. Springs 20 are typically a few thousands of an inch wider than slot or aperture 12, fabricated from a metal such as beryllium or tempered copper about 0.008 inch thick, depending on the desired spring constant. More generally, springs 20 can be made of other metals or other electrically conductive material.

Figure 2:
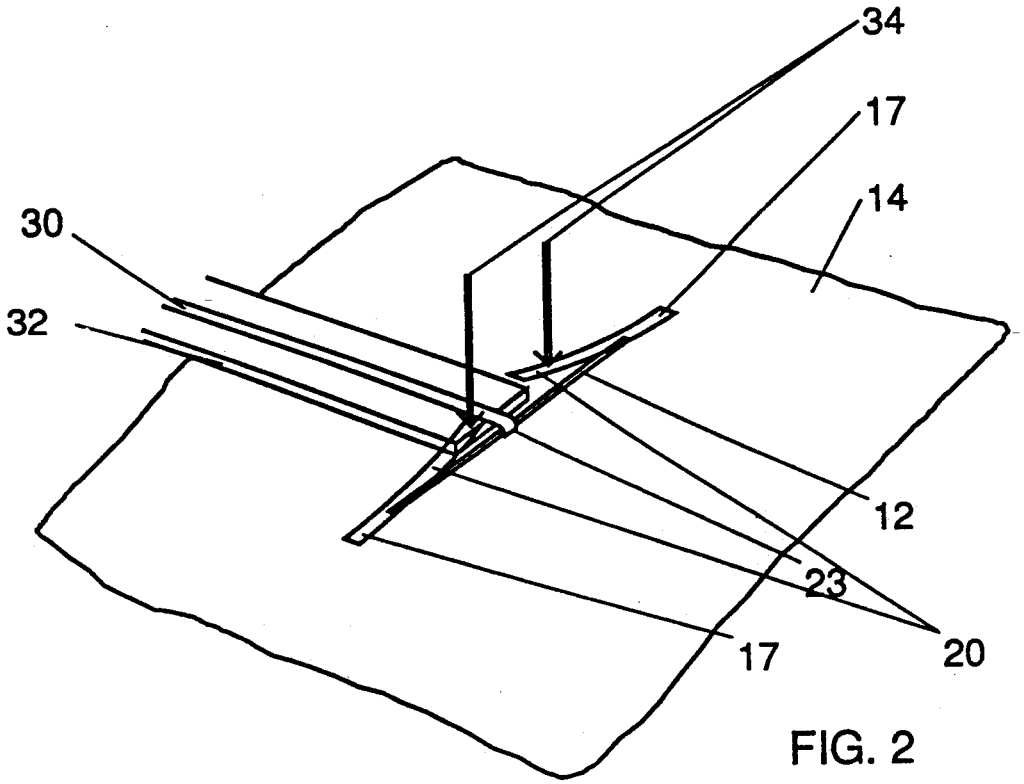
FIG. 2: A perspective view in accordance with the invention depicting its use to adjust the aperture or slot coupling, as fed by a microstrip line.
Figure 3:
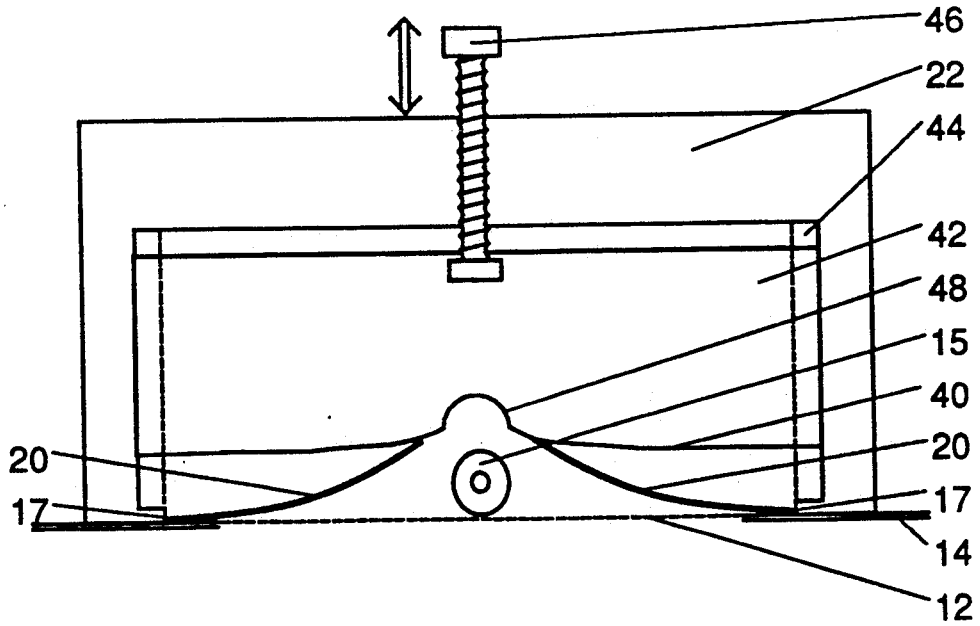
FIG. 3: A cross-sectional view of the invention depicting a mechanical method for symmetrically adjusting the positions of both leaf springs which partially cover the aperture or slot.

FIG. 2 shows the invention in which the slot 12 is fed by a microstrip line 30 on a dielectric substrate 32 mounted on the back side (top) of ground plane 14. Here, the conducting microstrip 30 is extended across slot 12 and electrically fastened to the ground plane 14 at point 23. As in FIG. 1, the invention utilizes two leaf springs 20 which are electrically connect at ends 17 to the ends of slot 12. Schematically, FIG. 2 shows mechanical forces 34 being applied to press the two springs 20 toward slot 12 so as to adjust the coupling of electromagnetic energy through the slot. The mechanical forces 34 can be applied in a variety of ways such as the coupling adjustment screws 24 in FIG. 1, or the plunger arrangement in FIG. 3. In FIG. 3, shown in vertical cross section along slot 12, the springs 20 are symmetrically advanced toward or retracted away from slot 12 by means of a light weight, conducting or non-conducting guillotine-like plunger 42 which slides in guide grooves 44 on either side of the backing cavity 22. Plunger 42 is symmetrically driven up and down by a single screw 46. This screw adjustment could also take the form of a micrometer shaft for very precise positioning. The bottom surface 40 of plunger 42 may be tapered toward the center and include a recess 48 which fits over cable 15.

Of the many applications of the invention, FIG. 4-A shows how the coupling between a microstrip line 54 and a slot line 56 in ground plane 14 can be adjusted using a single leaf spring 20 electrically connected at end 17 to the end of slot line 56. The crossing of two such lines at right angles is a well-known method for inductively coupling them. Typically, the microstrip line 54, which is insulted from ground plane 14 by a dielectric layer or substrate 52, extends beyond the center line of slot line 56 by length $L_1$. Similarly, the slot line 56 typically extends beyond the microstrip line by length $L_2$. To achieve the strongest coupling between the two lines, $L_1$ and $L_2$ are both chosen to be one quarter wavelength along strip line 54 or slot line 56. Then the current standing wave on the open-circuited microstrip line 54 and the voltage standing wave on the short circuit slot line 56 are both maximum where the lines cross, resulting in the maximum possible coupling between the two lines. Alternatively, with this invention the microstrip line 54 can be electrically connected directly across the slot line 56 as in FIG. 2, or the microstrip line 54 can be replaced by a coaxial line electrically connected across the slot line as in FIG. 1.

With this invention, the coupling between the two lines can be adjusted between zero and maximum as desired by simple adjustment of the single leaf spring 20 using mechanical force 34 as discussed previously in FIGS. 1-3. Such adjustment may be useful for adjusting the coupling to a device terminating either line, usually over a relatively narrow frequency range. For example, this invention is useful for regulating the coupling to a dielectric resonator (not shown) placed in proximity to the slot line 56. In this case, the coupling can easily be adjusted in a smoothly controllable manner without physically changing the position of the resonator with respect to the slot line.

FIG. 4-B shows the same crossed microstrip line 54 and slot line 56 wherein the coupling between them is adjusted by a sliding metal strip 58 over the end of slot line 56. By mechanical adjustment, metal strip 58 can be moved left or right, guided by either conducting or non-conducting guides 59. In this manner the electric field across the end of slot line 56 is adjusted according to the position of sliding strip 58, thereby adjusting the coupling between microstrip 54 and slot line 56.

CONCLUSION AND SCOPE OF INVENTION

While the above descriptions of different embodiments contain many specificities, these should not be construed as limitations on the scope of the invention. Rather, they are exemplifications of preferred embodiments. Many other variations and applications are possible.

Although the illustrated embodiments show a planar ground plane 14 and linear slot 12, this is not necessary. Both could be curved provided that the shape of the mechanism (e.g., leaf springs 20 in FIGS. 1-4A, or sliding metal strip 58 in FIG. 4B) for adjusting the electric field in the slot 20 or slot line 56 is modified accordingly. Similarly, the invention is not limited by use of adjustment screws 24 in FIG. 1 or 46 in FIG. 3; other force applying means and methods can be devised which will serve equally well.

The invention is not limited to slots, and applies equally to wide apertures, slot lines, etc. Neither is it limited by the feed network which can take the form of a coaxial line, microstrip line, strip line, etc. Finally, the invention is not limited to the material, device, line, etc. to which the slot fields are coupled on the front side of ground plane 14.

Changes and modifications in the specifically described embodiments can be carried out without departing from the scope of the invention, which is intended to be limited only by the scope of the appended claims.

We claim:

1. Apparatus for adjusting electromagnetic coupling between two regions, comprising:

a thin conductive ground plane separating the two regions;

a slot in the ground plane through which power coupling occurs;

means for guiding power to and/or from the slot;

at least one curved conducting leaf spring operatively connected to the slot for adjusting the electromagnetic coupling through the slot.

2. The apparatus of claim 1 wherein each conducting leaf spring is electrically and mechanically connected to the ground plane at an end of the slot such that the spring progressively curves away from the slot along the distance from the end toward the center of the slot.

3. The apparatus of claim 2 further comprising force applying means to cause the leaf spring to progressively cover or uncover the slot, thereby adjusting the coupling of power through the slot.

4. The apparatus of claim 3 further comprising a conductive enclosure fixedly attached to the ground plane that covers the slot and the at least one leaf spring to reduce electromagnetic radiation from the slot and to provide support for the force applying means.

5. The apparatus of claim 3 wherein the force applying means comprises a coupling screw.

6. The apparatus of claim 3 wherein the force applying means comprises a mechanical plunger.

7. The apparatus of claim 2 wherein there are two leaf springs, one attached at each end of the slot.

8. The apparatus of claim 7 wherein each spring has a width greater than the width of the slot and a length less than half the length of the slot.

9. The apparatus of claim 1 wherein there are two leaf springs.

10. The apparatus of claim 9 wherein each spring has a width greater than the width of the slot and a length less than half the length of the slot.

11. The apparatus of claim 1 further comprising a conductive enclosure fixedly attached to the ground plane that covers the slot and the at least one leaf spring to reduce electromagnetic radiation from the slot.

12. The apparatus of claim 1 wherein the means for guiding power to and/or from the slot is a coaxial cable.

13. The apparatus of claim 1 wherein the means for guiding power to and/or from the slot is a microstrip line.

14. Apparatus for adjusting electromagnetic coupling between two regions, comprising:

a thin conductive ground plane separating the two regions;

a slot in the ground plane through which power coupling occurs;

means for guiding electromagnetic power to and/or from the slot;

two curved conductive leaf springs fixedly attached, one at each end of the slot and extending toward the center of the slot such that both springs progressively curve away from the slot along the distance from the ends toward the center of the slot;

coupling adjustment actuation means operatively connected to the two leaf springs to apply mechanical force to cause both leaf springs to progressively cover or uncover the slot, thereby adjusting the coupling of power through the slot.

15. A method for adjusting electromagnetic coupling between two regions separated by a thin conductive ground plane having a slot formed therein through which power coupling occurs, comprising progressively covering or uncovering a portion of the slot with a conductive material to adjust the coupling of power through the slot by attaching a curved conductive leaf spring to the ground plane at an end of the slot such that the spring progressively curves away from the slot along the distance toward the center of the slot and forcing the spring to cover more or less of the length of the slot.

16. The method of claim 15 further comprising attaching a second curved conductive leaf spring to the opposite end of the slot and also forcing the second spring to cover more or less of the length of the slot.

17. Apparatus for adjusting electromagnetic coupling between two regions, comprising:

a thin conductive ground plane separating the two regions;

a slot in the ground plane through which power coupling occurs;

means for guiding power to and/or from the slot;

a curved conductive leaf spring fixedly attached to one end of the slot and extending toward the center of the slot such that the spring progressively curves away from the slot along the distance from the end toward the center of the slot;

coupling adjustment actuation means operatively connected to the leaf spring to apply mechanical force to cause the leaf spring to progressively cover or uncover the slot, thereby adjusting the coupling of power through the slot.

* * * * *